US009097066B2

(12) United States Patent
Hensley et al.

(10) Patent No.: US 9,097,066 B2
(45) Date of Patent: Aug. 4, 2015

(54) METHOD, SYSTEM AND APPARATUS FOR DEPLOYMENT OF UMBILICALS IN SUBSEA WELL OPERATIONS

(75) Inventors: John Rodney Hensley, Katy, TX (US); Zachary P. Schneider, Houston, TX (US); Evan P. Graybill, Houston, TX (US); Thomas E. O'Donnell, Houston, TX (US); Timothy Achee, Katy, TX (US); Raymond Stawaisz, The Woodlands, TX (US); Trevor Munk, Houston, TX (US); Omid Oujani, Houston, TX (US); Thomas B. Heyward, Houston, TX (US)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

(21) Appl. No.: 13/324,687

(22) Filed: Dec. 13, 2011

(65) Prior Publication Data

US 2012/0152556 A1 Jun. 21, 2012

Related U.S. Application Data

(60) Provisional application No. 61/422,557, filed on Dec. 13, 2010.

(51) Int. Cl.

| | |
|---|---|
| ***E21B 43/01*** | (2006.01) |
| ***E21B 19/00*** | (2006.01) |
| ***E21B 17/01*** | (2006.01) |
| ***E21B 33/035*** | (2006.01) |

(52) U.S. Cl.

CPC ..... *E21B 19/002* (2013.01); *E21B 17/01* (2013.01); *E21B 33/0355* (2013.01)

(58) Field of Classification Search

CPC ..... E21B 17/023; E21B 17/026; E21B 19/09; E21B 19/02; E21B 17/01; E21B 19/002; E21B 33/0355

USPC ..... 166/338–339, 349, 351, 360, 367, 345, 166/350; 405/190

See application file for complete search history.

(56) References Cited

U.S. PATENT DOCUMENTS

| | | | | |
|---|---|---|---|---|
| 4,437,791 A * | 3/1984 | Reynolds | 405/224.2 |
| 5,542,776 A * | 8/1996 | Reynolds | 403/389 |
| 5,660,233 A * | 8/1997 | Sparks | 166/367 |
| 7,363,968 B1 * | 4/2008 | Baugh | 166/77.1 |

(Continued)

FOREIGN PATENT DOCUMENTS

| | | | |
|---|---|---|---|
| WO | 2010-042873 | 4/2010 | |
| WO | WO 2012080242 A2 * | 6/2012 | F16L 3/237 |

OTHER PUBLICATIONS

International Search Report for PCT/US2011/064706 dated Jul. 18, 2012, 3 pages.

*Primary Examiner* — James G Sayre
(74) *Attorney, Agent, or Firm* — Parul Anderson

(57) ABSTRACT

In subsea drilling operations, workover control systems may include deployment of an umbilical from a deepwater drilling vessel. Such an umbilical provides support functions for deepwater drilling operations. In the practice of the invention, a new method, system and apparatus may be employed to deploy the umbilical independently of the drilling riser, which provides commercial and operational advantages. That is, the umbilical may be deployed at a different time than the riser is deployed, and also without intimate close connection from the umbilical to the riser.

17 Claims, 15 Drawing Sheets

(56) References Cited

U.S. PATENT DOCUMENTS

| | | | | |
|---|---|---|---|---|
| 7,614,593 | B2 * | 11/2009 | McClure et al. | 248/229.14 |
| 8,408,311 | B2 * | 4/2013 | Grayson et al. | 166/367 |
| 2004/0074649 | A1 | 4/2004 | Hatton et al. | |
| 2008/0149343 | A1 * | 6/2008 | Chitwood et al. | 166/360 |
| 2008/0223583 | A1 | 9/2008 | Roveri | |
| 2008/0264642 | A1 | 10/2008 | Horton | |
| 2009/0252559 | A1 * | 10/2009 | Masters et al. | 405/195.1 |
| 2011/0067881 | A1 * | 3/2011 | Blake | 166/352 |
| 2014/0041878 | A1 * | 2/2014 | Hatton | 166/350 |

* cited by examiner

400

METHOD, SYSTEM AND APPARATUS FOR DEPLOYMENT OF UMBILICALS IN SUBSEA WELL OPERATIONS

CROSS-REFERENCE TO RELATED APPLICATIONS

The present application claims priority to U.S. Provisional Patent Application No. 61/422,557, entitled "Method, System And Apparatus For Deployment Of Umbilicals In Subsea Well Operations" and filed on Dec. 13, 2010, and is related to U.S. patent application Ser. No. 13/217,440, entitled "Riser-Mounted Guide Assembly For Umbilical Deployment" and filed on Aug. 25, 2011, the entire disclosures of which are hereby fully incorporated herein by reference.

TECHNICAL FIELD

The present application generally relates to subsea drilling operations. More particularly, the present application relates to the deployment of a workover controls systems umbilical from a deepwater drilling vessel.

BACKGROUND

Current deployment techniques for an installation and workover control system (IWOCS) in connection with subsea drilling umbilicals utilize mechanically supporting the vertical self weight loads and hydrodynamically induced lateral forces with clamps for attachment to a drilling riser. Generally, the IWOCS umbilical is a means for providing electro-hydraulic control to a subsea tree during tree installation, well completion, and well workover activities. Conventional deployment methods involve clamping the electro-hydraulic IWOCS umbilical directly to each joint (generally spaced about 75 feet apart) of drilling riser when the riser and lower marine riser package (LMRP)/blow out preventer (BOP) stack are deployed. An IWOCS is used in conventional operations to meet the requirements of vertical and horizontal completions for subsea drilling operations. Major system elements typically include: Workover Control Panel, a Workover Reel and Umbilical, and an Umbilical Termination Assembly (UTA). Inherent conventional deployment methodology is the expenditure of additional critical path (centerline) time required to make up the clamps and safety risks in deployment. Clamping the umbilical to riser requires approximately ten minutes per riser joint to install clamps, which represents a delay to the critical path operation. Therefore in 7,000 feet water depth, approximately 16 hours of rig time could be saved per riser trip by avoiding the need for installing clamps on critical path.

Additionally, if an umbilical or termination assembly malfunctions for any reason, the entire marine riser, BOP and/or LMRP must be recovered from the ocean floor to the rig surface to access and repair the umbilical. Such recovery is very time consuming and expensive, as it requires substantial work and time for recovery operations. Therefore, a need has existed for many years for a process to effectively and efficiently de-couple the IWOCS umbilical from the drilling riser.

SUMMARY

The present invention is directed to methods for deploying and/or retrieving an electro-hydraulic umbilical independent from a drilling riser in connection with offshore drilling. The present invention is also directed to systems for implementing such methods.

In one aspect of the invention, an installation and workover control system includes a drilling riser that extends between a drilling unit, such as a drilling vessel, and a subsea controls package on the ocean floor, such as a LMRP/BOP stack, an umbilical that extends between the drilling unit and the subsea controls package, and at least one guide assembly, or guide structure, for securing the umbilical to the drilling riser. The guide assemblies are configured to allow for deployment and retrieval of the umbilical independently from the drilling riser.

In another aspect of the invention, a method of installing a workover controls system for deployment of an umbilical from a drilling vessel includes the steps of deploying a drilling riser from the drilling vessel into the ocean, deploying the umbilical from the drilling vessel into the ocean, whereby the umbilical is deployed independently from the drilling riser, and securing the umbilical to the drilling riser with one or more guide structures.

In yet another aspect of the invention, a method of deploying or retrieving an umbilical includes the steps of conveying an umbilical from a drilling unit to or from a position below a surface of the ocean, monitoring the tension of the umbilical, and restraining the umbilical laterally with riser mounted guide structures. As used herein, the term "conveying" refers to raising or lowering of the umbilical. The umbilical is conveyed independently and laterally offset from a drilling riser, whereby the drilling riser is associated with the drilling unit and also extends into the ocean.

The features of the present invention will be readily apparent to those skilled in the art upon a reading of the description of the preferred embodiments that follows.

BRIEF DESCRIPTION OF THE DRAWINGS

For a more complete understanding of the exemplary embodiments of the present invention and the advantages thereof, reference is now made to the following description in conjunction with the accompanying drawings, which are briefly described as follows.

DETAILED DESCRIPTION OF THE INVENTION

Figure 1A:
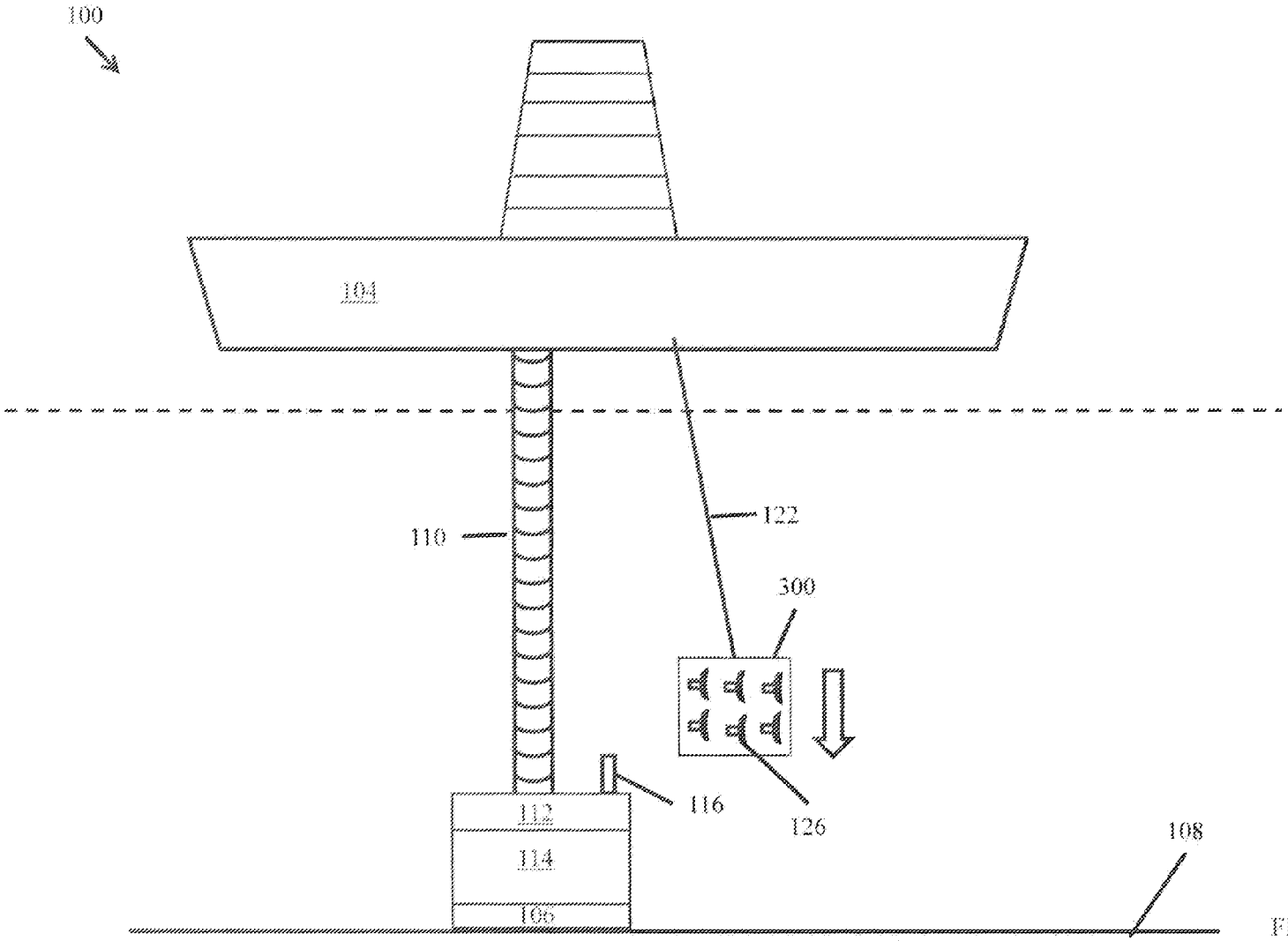
FIG. 1A is an illustration showing deployment of a guide basket carrying guides for attachment to a drilling riser, according to an exemplary embodiment.

The systems and methods of the present invention generally include installation and workover control systems (IWOCS) that allow for flexibility to deploy and retrieve an umbilical independent from the drilling riser and blow out preventer and/or lower marine riser package stack. The umbilical can support an umbilical termination assembly, self weight of the system, and additional operational tensions resulting from metocean conditions. The present IWOCS deployment and retrieval method will take the umbilical off of the critical path of drill floor operations which directly improves riser running/pulling efficiency.

Illustrative embodiments of the invention are described below. In the interest of clarity, not all features of an actual implementation are described in this specification. One of ordinary skill in the art will appreciate that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present invention may be better understood by reading the following description of non-limitative embodiments with reference to the attached drawings wherein like parts of each of the figures are identified by the same reference characters. The words and phrases used herein should be understood and interpreted to have a meaning consistent with the understanding of those words and phrases by those skilled in the relevant art. No special definition of a term or phrase, for example, a definition that is different from the ordinary and customary meaning as understood by those skilled in the art, is intended to be implied by consistent usage of the term or phrase herein. To the extent that a term or phrase is intended to have a special meaning, for instance, a meaning other than that understood by skilled artisans, such a special definition will be expressly set forth in the specification in a definitional manner that directly and unequivocally provides the special definition for the term or phrase.

FIGS. 1A-1G illustrate an IWOCS system 100 for deployment of an umbilical 102 (FIGS. 1C-1G) from a deepwater drilling vessel 104, according to an exemplary embodiment. Referring to FIG. 1A, the system 100 includes a subsea tree 106, which can be controlled by the umbilical 102, installed onto a top of a well (not shown) at a deep sea floor 108. In certain embodiments, the system 100 may provide electro-hydraulic control and chemical injection to the subsea tree 106 during completion, flowback and tree testing operations. However, a hydraulic control system without electrical conductors also could be used. A drilling riser 110 that is coupled to a lower marine riser package (LMRP) 112 and blowout preventer (BOP) 114 stack is lowered from the drilling vessel 104 and the LMRP/BOP stack is secured to the tree 106. In certain embodiments, the LMRP 112 includes a kingpost or a guidepost 116 coupled thereto and positioned parallel to the drilling riser 110. A guide basket 300 (FIG. 3) also can be deployed from the drilling vessel 104. In certain embodiments, the guide basket 300 can be lowered to the deep sea floor 108 by a stainless steel winch wire 122. The guide basket 300 can carry multiple guides 126 for securing the umbilical 102 to the drilling riser 110.

Figure 1B:
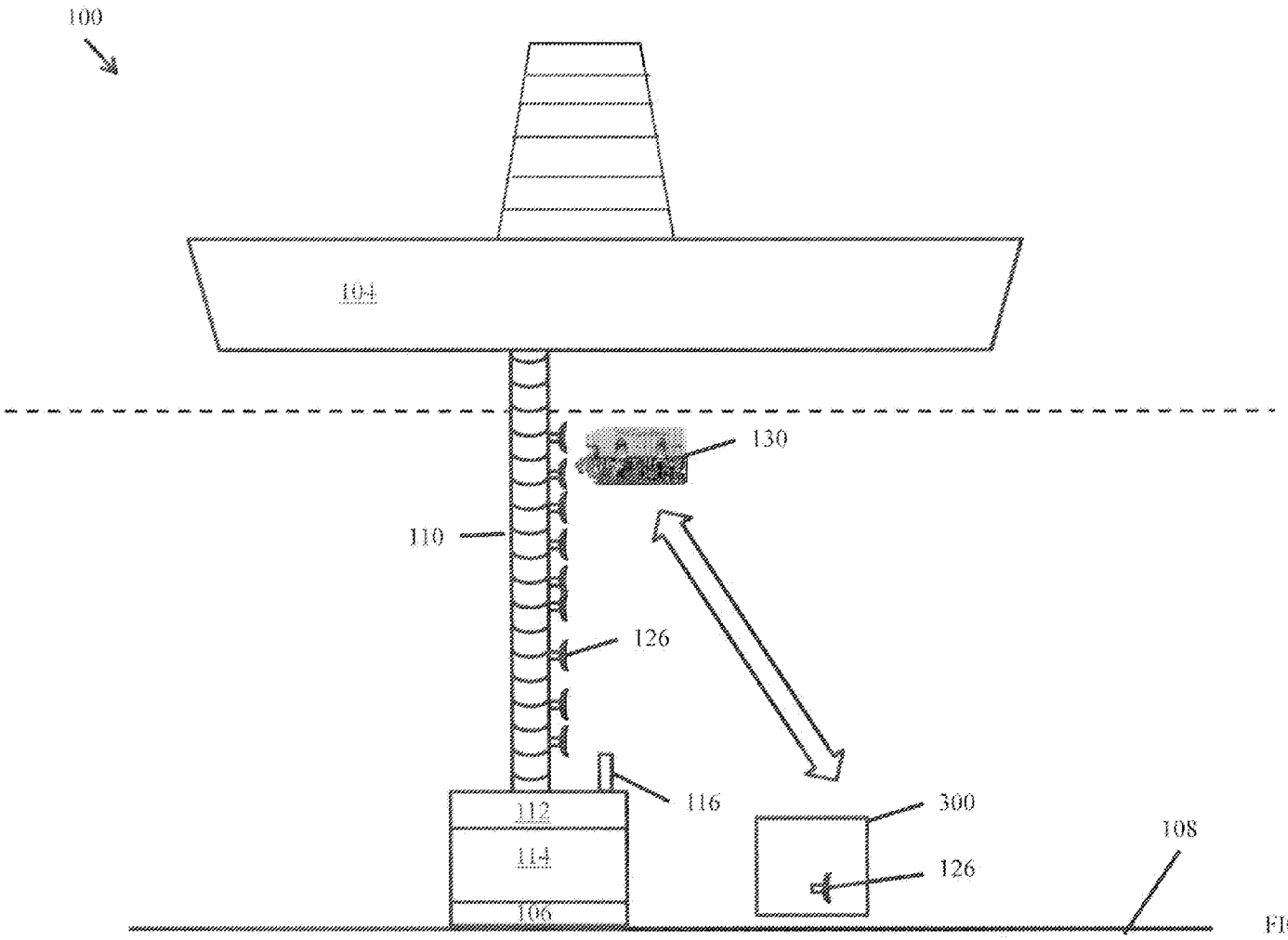
FIG. 1B is an illustration showing a remotely operated vehicle installing the guides on the drilling riser, according to an exemplary embodiment.

Referring to FIG. 1B, after the guide basket 300 is deployed to the deep sea floor 108, the winch wire 122 is disconnected from the guide basket 300 and retracted to the drilling vessel 104. A remotely operated vehicle (ROV) 130 then installs the guides 126 onto the drilling riser 110. In certain exemplary embodiments, the guides 126 are coupled to flanges (not shown) on the drilling riser 110. In certain alternative embodiments, the guides 126 are connected to portions of the drilling riser 110 other than the flange area, such as to the main body or auxiliary lines of the drilling riser 110. In certain embodiments, the guides 126 are installed to the drilling riser 110 by the ROV 130 in a downward direction from the drilling vessel 104 towards the LMRP 112. In certain alternative embodiments, the guides 126 are installed to the drilling riser 110 in an upward direction from the LMRP 112 towards the drilling vessel 104. In other embodiments, the guides 126 are installed to the drilling riser 110 from the center of the drilling riser 110 outward towards the LMRP 112 and the drilling vessel 104. In yet other embodiments, the guides 126 can be installed onto the drilling riser 110 in the moonpool area (not shown) of the drilling vessel 104 prior to deployment of the drilling riser 110. In order to prevent the development of any damaging vortex-induced vibrations underwater, the spacing of the guides 126 can be optimized to prevent the vortex shedding frequency (f) from approaching the natural resonant frequency of the umbilical 102. In one embodiment, the guides 126 may be unequally spaced along the length of the drilling riser 110 as a result of performing fluid dynamic analyses including calculation of the Strouhal (St) number, which is characteristically equal to 0.20 for cylinders:

$$St = \frac{fL}{V}$$

In certain embodiments, approximately nine guides 126 may be secured to the drilling riser 110. In other applications, more or less than nine guides 126 may be used. Generally, water depth and ocean conditions will determine the number of guides 126 required. Each guide 126 may allow vertical motion of the umbilical 102, but may restrict lateral movement, thereby minimizing point loading at the entrance/exit points of each guide 126. It is desirable to impart minimal frictional wear to the umbilical 102.

Figure 1C:
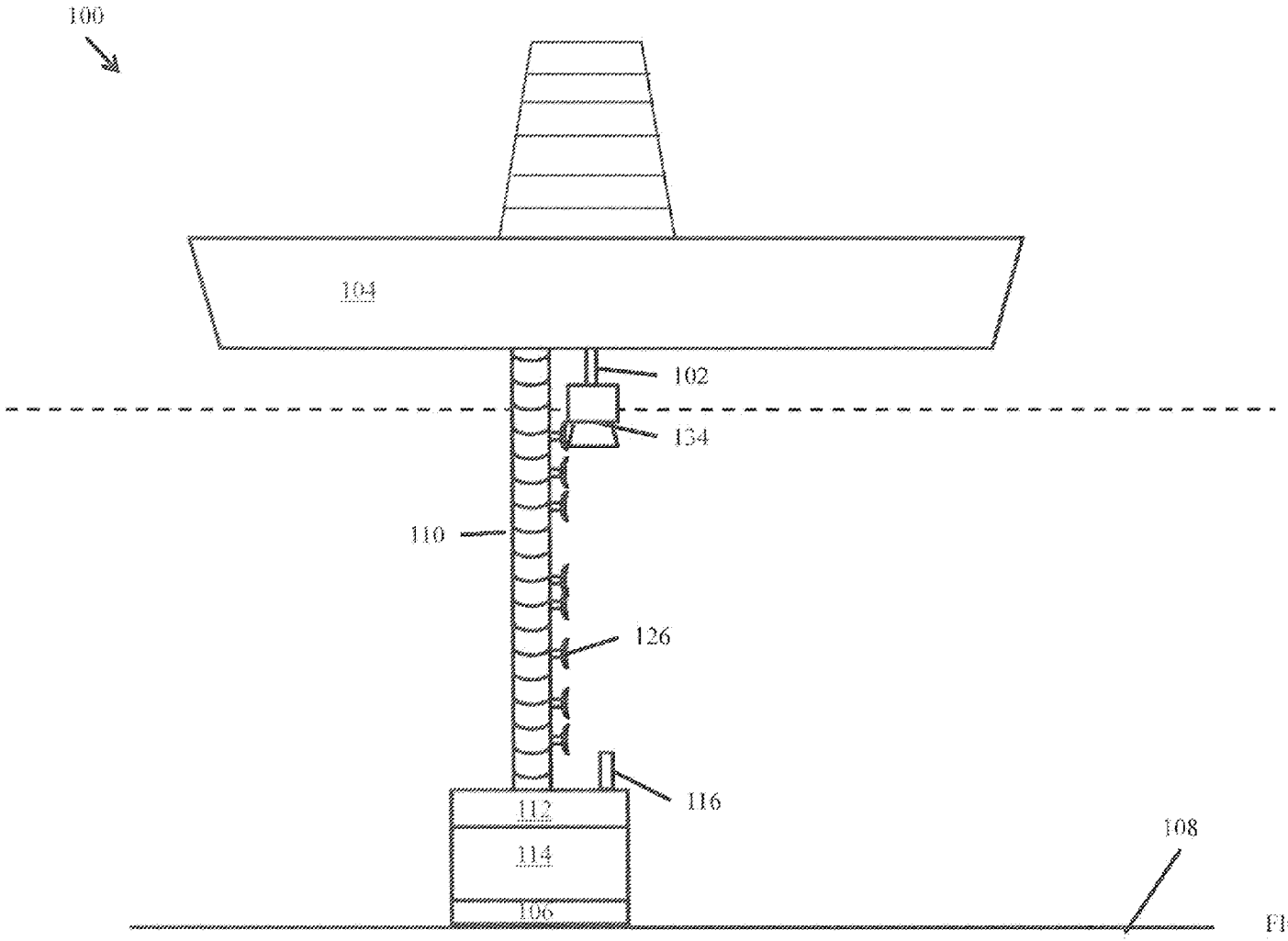
FIG. 1C is an illustration showing deployment of an umbilical and an umbilical termination assembly, according to an exemplary embodiment.
Figure 1D:
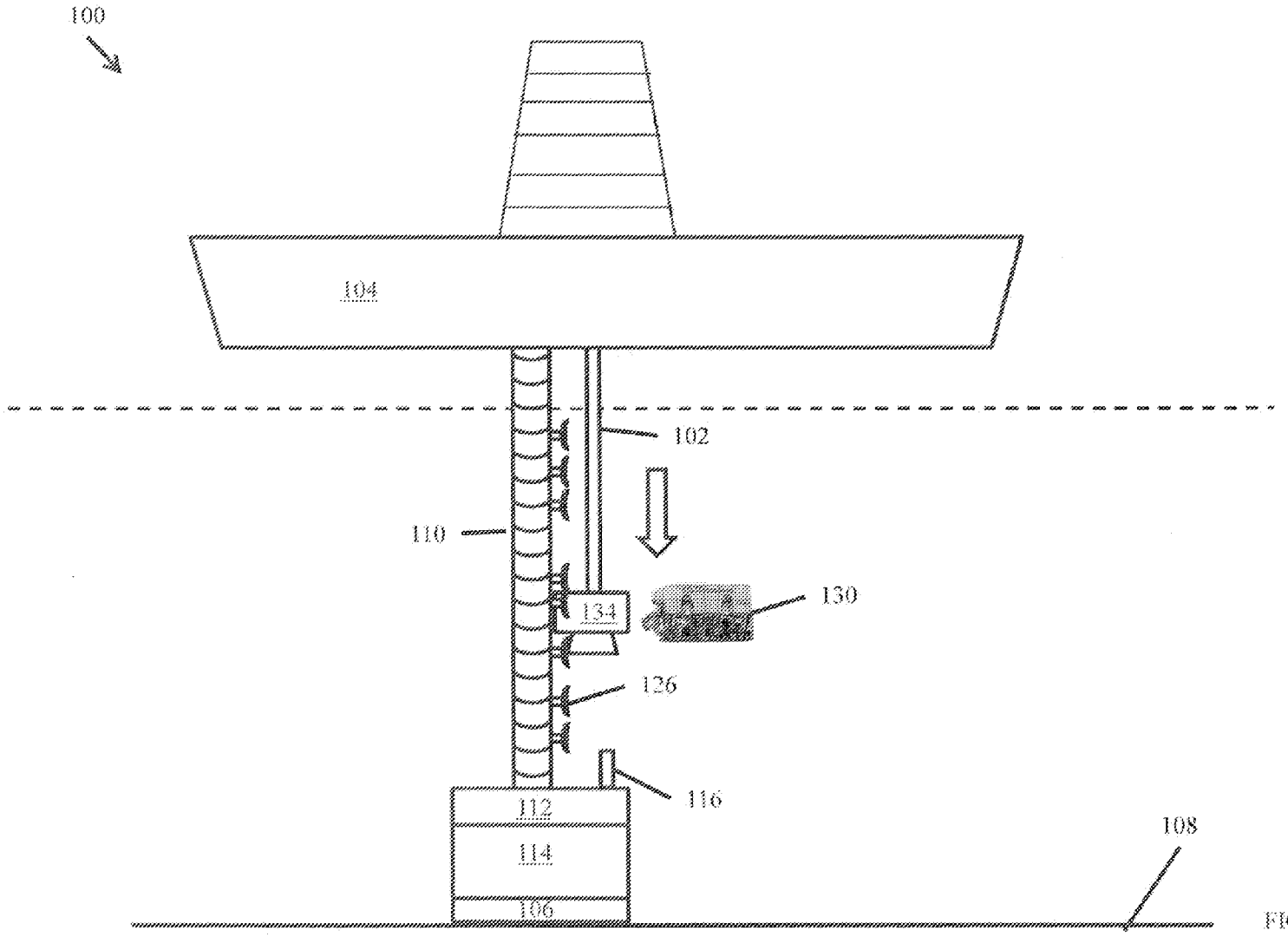
FIG. 1D is an illustration showing the remotely operated vehicle guiding the umbilical termination assembly during deployment, according to an exemplary embodiment.
Figure 1E:
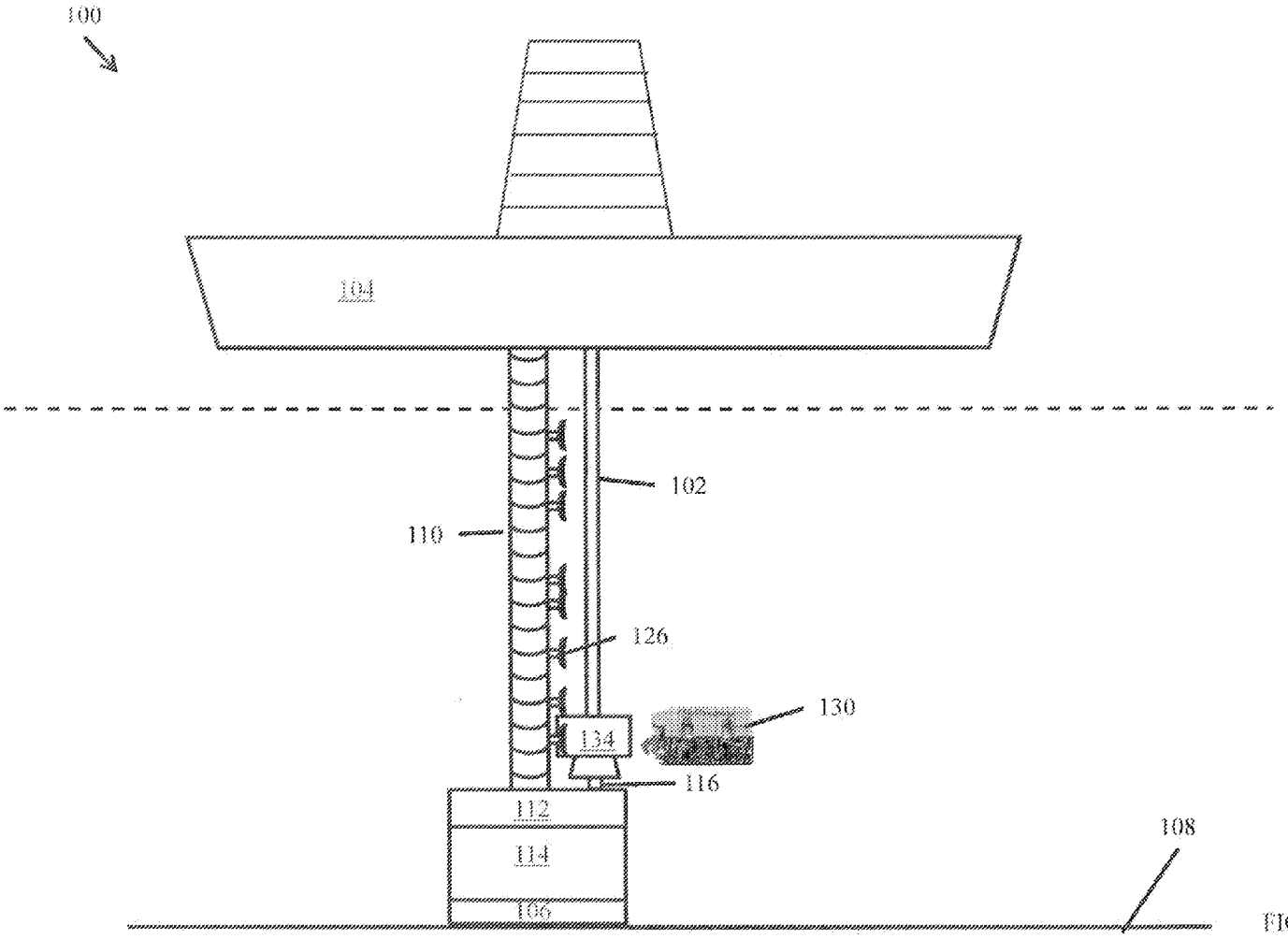
FIG. 1E is an illustration showing the remotely operated vehicle securing an umbilical termination assembly to a kingpost, according to an exemplary embodiment.

Referring to FIGS. 1C-1E, after the guides 126 are installed on the drilling riser 110, the umbilical 102 for controlling the tree 106 is deployed from the drilling vessel 104 and is lowered towards the LMRP 112. Suitable examples of umbilicals for use in the system 100 include, but are not limited to Installation/Workover Control System (IWOCS) umbilicals (manufactured by and commercially available from JDR Cable Systems, Ltd., United Kingdom). In certain exemplary embodiments, the umbilical 102 include a polymeric outer sheath, such as a polyethylene sheath. In certain embodiments, the umbilical 102 has a diameter in the range of from about three inches to about three and half inches. In certain embodiments, the umbilical 102 may be constructed in such a fashion that it possesses high tensile strength, light weight, and high elasticity, with a safe tensile working load to exceed 30,000 lbs and maximum breaking load two to three times higher, by using an aramid fiber strength member. In certain embodiments, the umbilical 102 may be constructed to increase fatigue life over conventional umbilicals. In certain embodiments, a tension member or buoyancy material may be incorporated in or applied on the umbilical 102 externally, thereby providing lifting forces to reduce required tension at surface to control lateral offsets. In certain embodiments, the umbilical 102 has a tensile strength sufficient to withstand the drilling vessel heave (heave compensated). The umbilical 102 is coupled to an umbilical termination assembly (UTA) 134 for securing the umbilical 102 to the kingpost 116. In certain exemplary embodiments, the umbilical 102 may be deployed through a mobile offshore drilling unit, as for example, through the forward moonpool (not shown), adjacent the drilling riser 110. Generally, the umbilical 102 and UTA 134 are guided by the ROV 130 so as to avoid undesirable contact with riser components, choke/kill hoses, and rig structures. In one embodiment, in 7000 feet of water, the umbilical 102 and UTA 134 may be deployed feasibly in surface currents up to about 2.0 knots, provided the current is incident upon the drilling vessel 104 at a heading of no more than about 15 degrees off of the bow and up to about 0.5 knots when the current is incident on the beam of the drilling vessel 104. Referring to FIG. 1D, in certain embodiments, the ROV 130 stabilizes and guides the UTA 134 on its descent towards the kingpost 116. Referring to FIG. 1E, the ROV 130 then secures the UTA 134 to the kingpost 116.

Figure 1F:
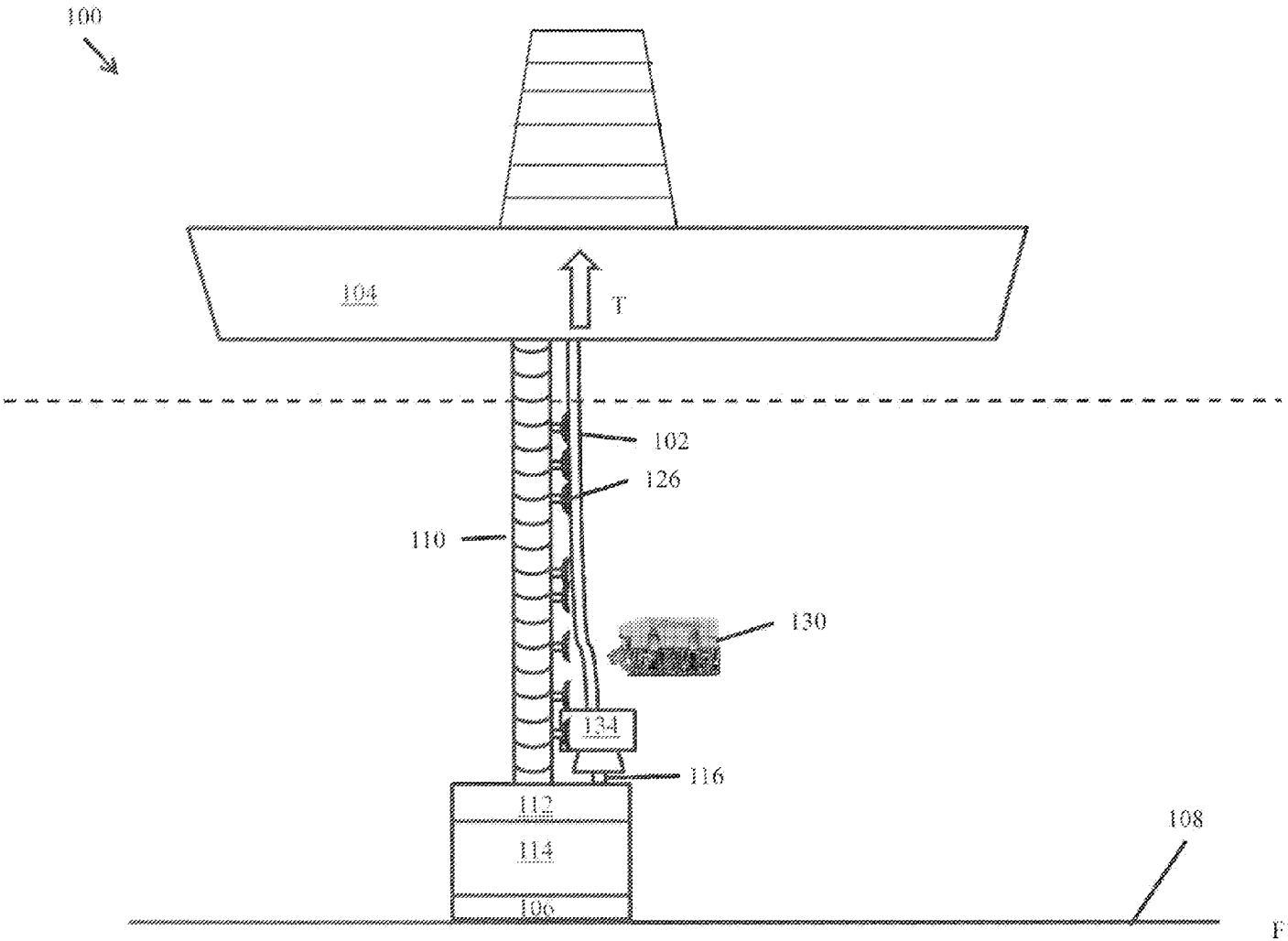
FIG. 1F is an illustration showing the remotely operated vehicle securing the umbilical within the guides, according to an exemplary embodiment.

Referring to FIG. 1F, after the UTA 134 is coupled to the kingpost 116, the ROV 130 secures the umbilical 102 within each of the guides 126 on the drilling riser 110. In certain embodiments, the ROV 130 has additional equipment mounted to the front of the vehicle, such as a curved front shovel portion, that is configured to capture the umbilical 102 and enable the ROV 130 to drive the umbilical 102 into place. In certain embodiments, the umbilical 102 is secured within the guides 126 in an upward direction starting nearest the deep sea floor 108 and progressing upward towards the drilling vessel 104. In alternative embodiments, the umbilical 102 is secured within the guides 126 in a downward direction from the drilling vessel 104 towards the deep sea floor 108. Generally, the guides 126 restrain the umbilical 102 from moving laterally, but facilitate axial travel. This may prevent umbilical "excursion" or undesirable wrapping of the umbilical 102 around the drilling riser 110. In certain embodiments, after the UTA 134 is secured to the kingpost 116, and axial top tension T may be applied on the umbilical 102 to enhance control of its contour and decrease its tendency to create a belly or bow shape through the water column prior to the ROV 130 securing the umbilical 102 within the guides 126. Due to this ability to control the umbilical 102 by manipulating the applied top tension T, the system 100 is less sensitive to current and weather conditions once the UTA 134 has landed and been locked in place to the kingpost 116.

Figure 1G:
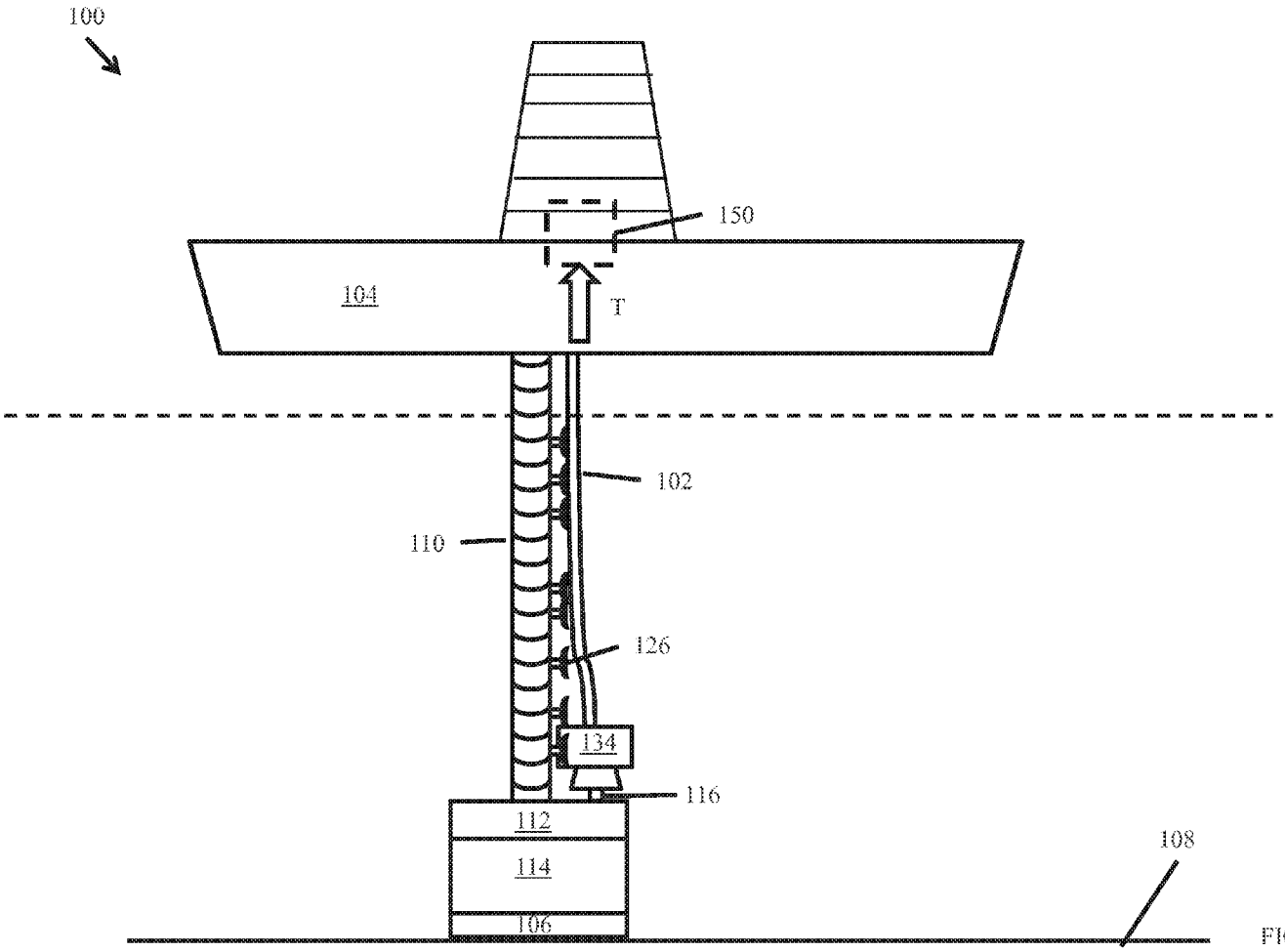
FIG. 1G is an illustration showing a top tension being applied on the umbilical after being secured within the guides, according to an exemplary embodiment.

Referring to FIG. 1G, after the umbilical 102 is secured within each of the guides 126, a top tension T may be applied on the umbilical 102 to reduce any excess slack that may be present. This top tension T may exceed the tension previously applied to the umbilical 102 during installation of the umbilical 102 into the guides 126. In certain exemplary embodiments, the tension in the umbilical 102 may be actively monitored using a load member 150 or load cell apparatus mounted on a shackle above the umbilical 102 sheave (not shown). Tension data also may be incorporated into operational plans during deployment. In certain embodiments, it may be desirable to maintain proper nominal top tension T on the umbilical 102 to limit fatigue damage due to waves and vortex-induced vibrations. Analytical calculations may be performed to dynamically model the entire system 100. In certain embodiments, alarms may be incorporated into a Master Control Panel (MCP) and rig safety systems (not shown). In one embodiment, in 7000 feet of water, the umbilical 102 tension is not actively heave-ompensated for the vertical motion of the drilling vessel 104 due to wave action. In this instance, the fluctuations in tension may be absorbed by the elasticity of the umbilical 102. In certain exemplary embodiments, in 7000 feet of water, the system 100 can operate with the umbilical 102 and UTA 134 connected, in currents up to about 2.5 knots, regardless of vessel heading and in metocean conditions resulting equivalent to the statistically derived "10 Year Winter Storm" in the Gulf of Mexico's Walker Ridge area, provided the umbilical 102 top tension is maintained at or above about 14-kips.

Figure 2:
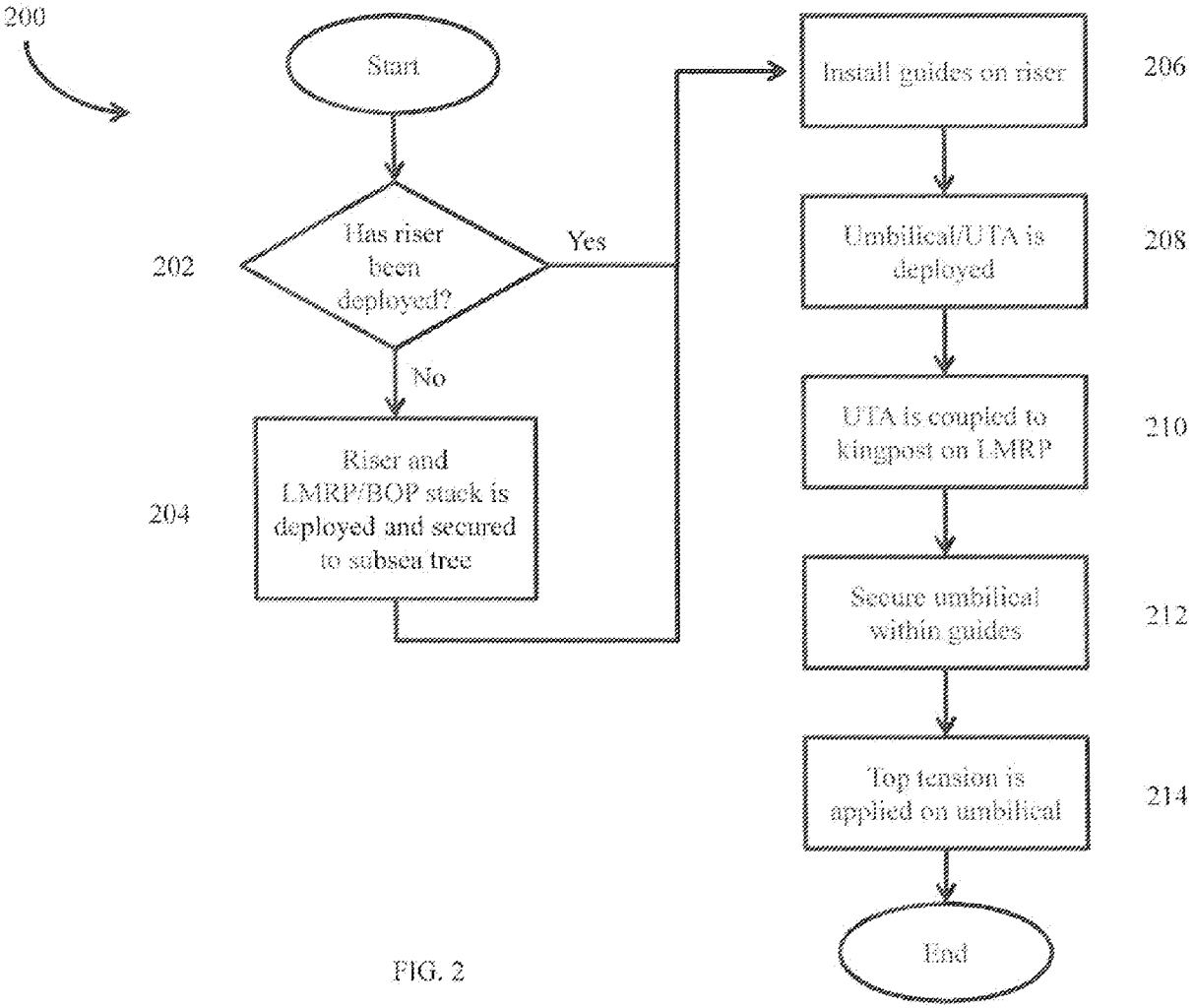
FIG. 2 is a flow diagram illustrating a method for installing a workover controls system for deployment of the umbilical of FIGS. 1C-1G, according to an exemplary embodiment.

FIG. 2 is a flow chart diagram illustrating a method 200 for installing a workover controls system for deployment of the umbilical 102 from the deepwater drilling vessel 104, independent from deployment of the drilling riser 110, according to an exemplary embodiment. The exemplary method 200 is illustrative, and in alternative embodiments of the invention, certain steps can be performed in a different order, in parallel with other another, or omitted entirely, and/or certain additional steps can be performed without departing from the scope and spirit of the invention. The method 200 is described below with reference to FIGS. 1A-1G.

In step 202, an inquiry is conducted to determine whether the drilling riser 110 has been deployed for use from the drilling vessel 104. If the drilling riser 110 has not been deployed, then the "no" branch is followed to step 204. In step 204, the drilling riser 110 coupled to the LMRP 112 and the BOP 114 is deployed and secured to the tree 106. Returning to step 202, if the drilling riser 110 has been deployed for use, then the "yes" branch is followed to step 206, where the guides 126 are installed onto the drilling riser 110. In step 208, the umbilical 102 coupled to the UTA 134 is deployed from the drilling vessel 104 and is lowered towards the LMRP 112. In step 210, the UTA 134 is secured to the kingpost 116 on the LMRP 112. In step 212, the umbilical 102 is secured within each of the guides 126 on the drilling riser 110. In step 214, a top tension T is applied on the umbilical 102.

Figure 3:
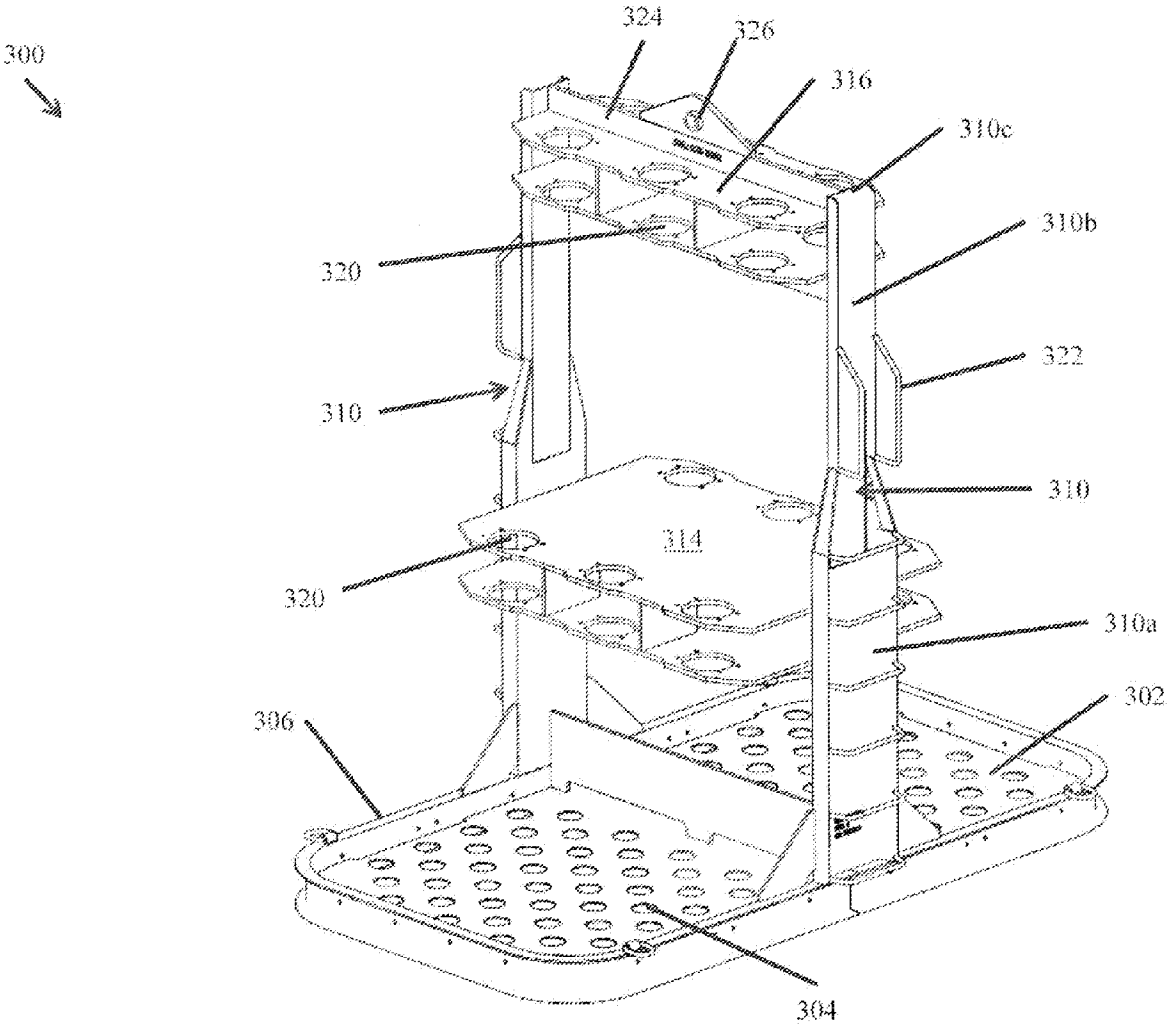
FIG. 3 is a perspective view of a guide basket, according to an exemplary embodiment.
Figure 4A:
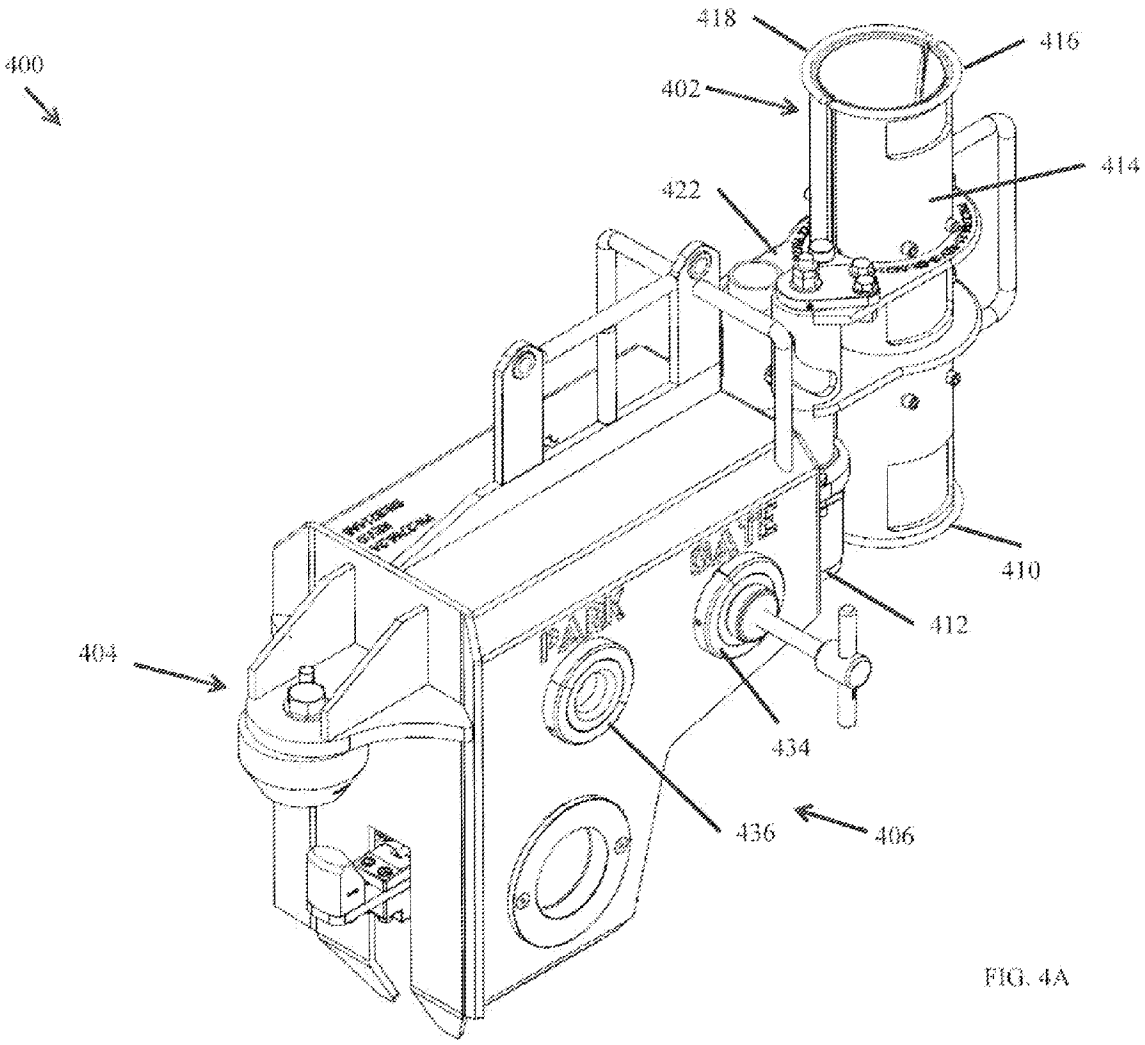
FIG. 4A is a right-side top perspective view of a guide, according to an exemplary embodiment.
Figure 4B:
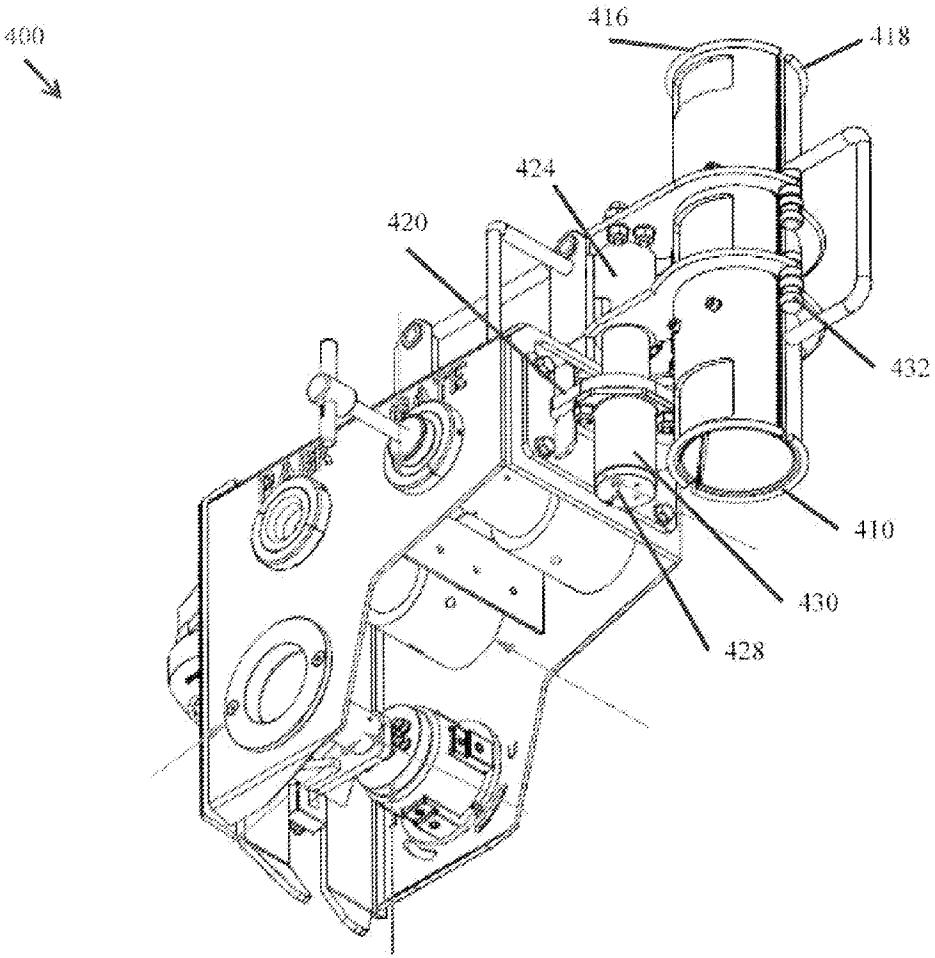
FIG. 4B is a right-side bottom perspective view of the guide of FIG. 4A, according to an exemplary embodiment.
Figure 4C:
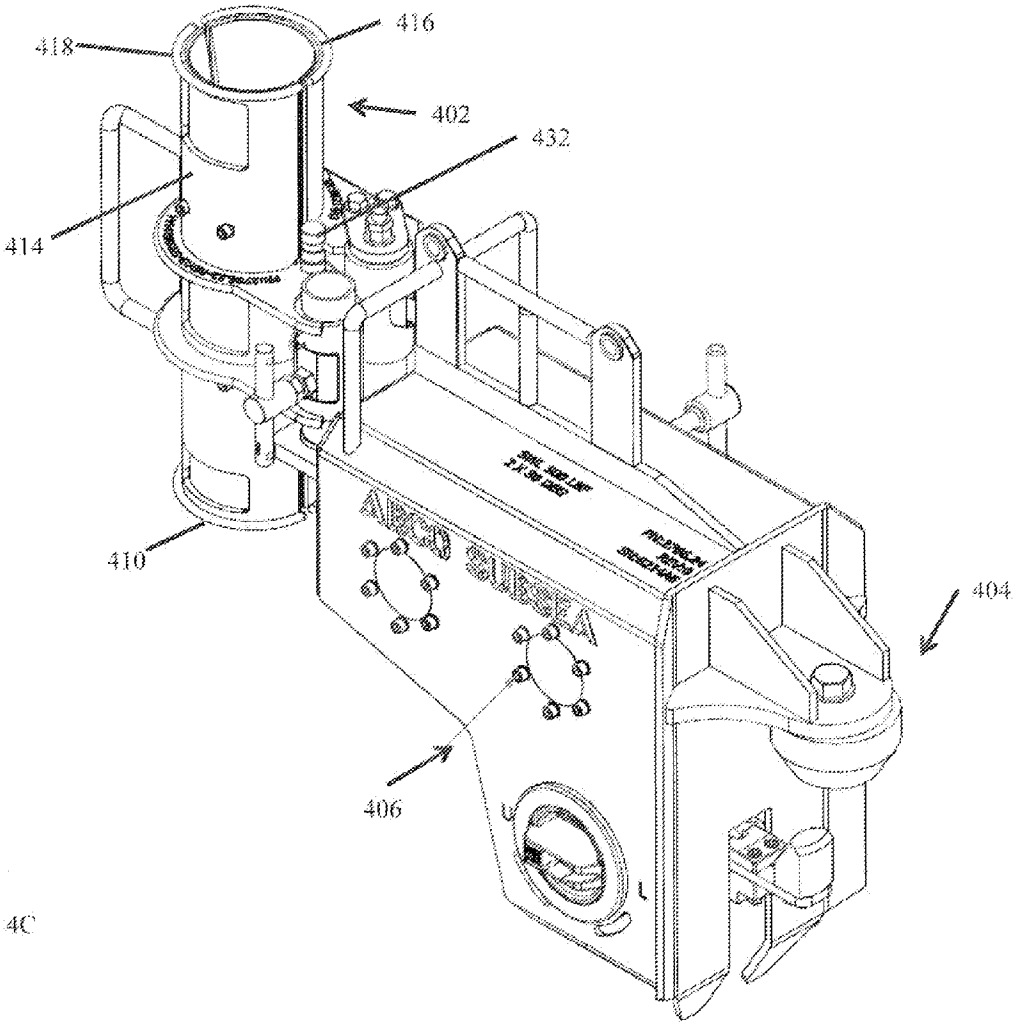
FIG. 4C is a left-side top perspective view of the guide of FIG. 4A, according to an exemplary embodiment.
Figure 4D:
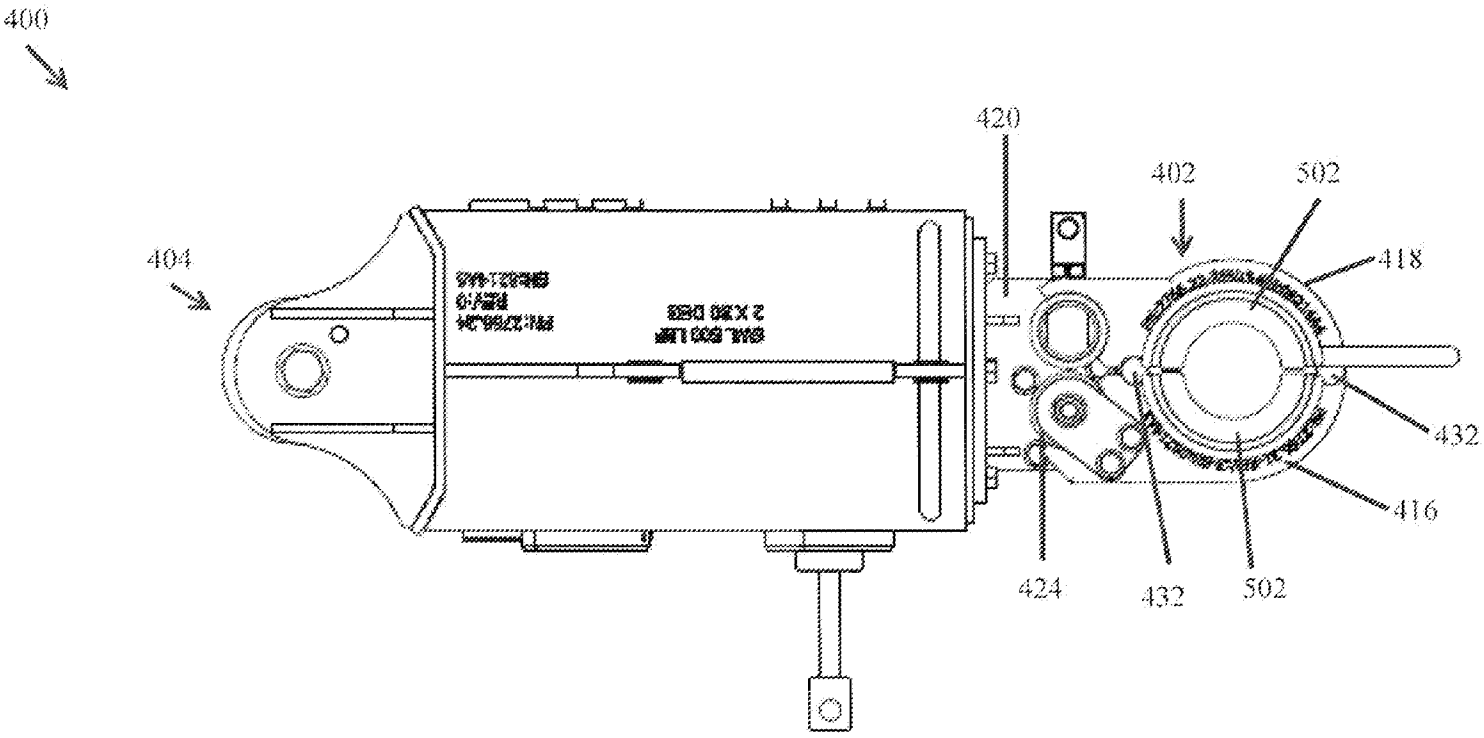
FIG. 4D is top view of the guide of FIG. 4A, according to an exemplary embodiment.
Figure 4E:
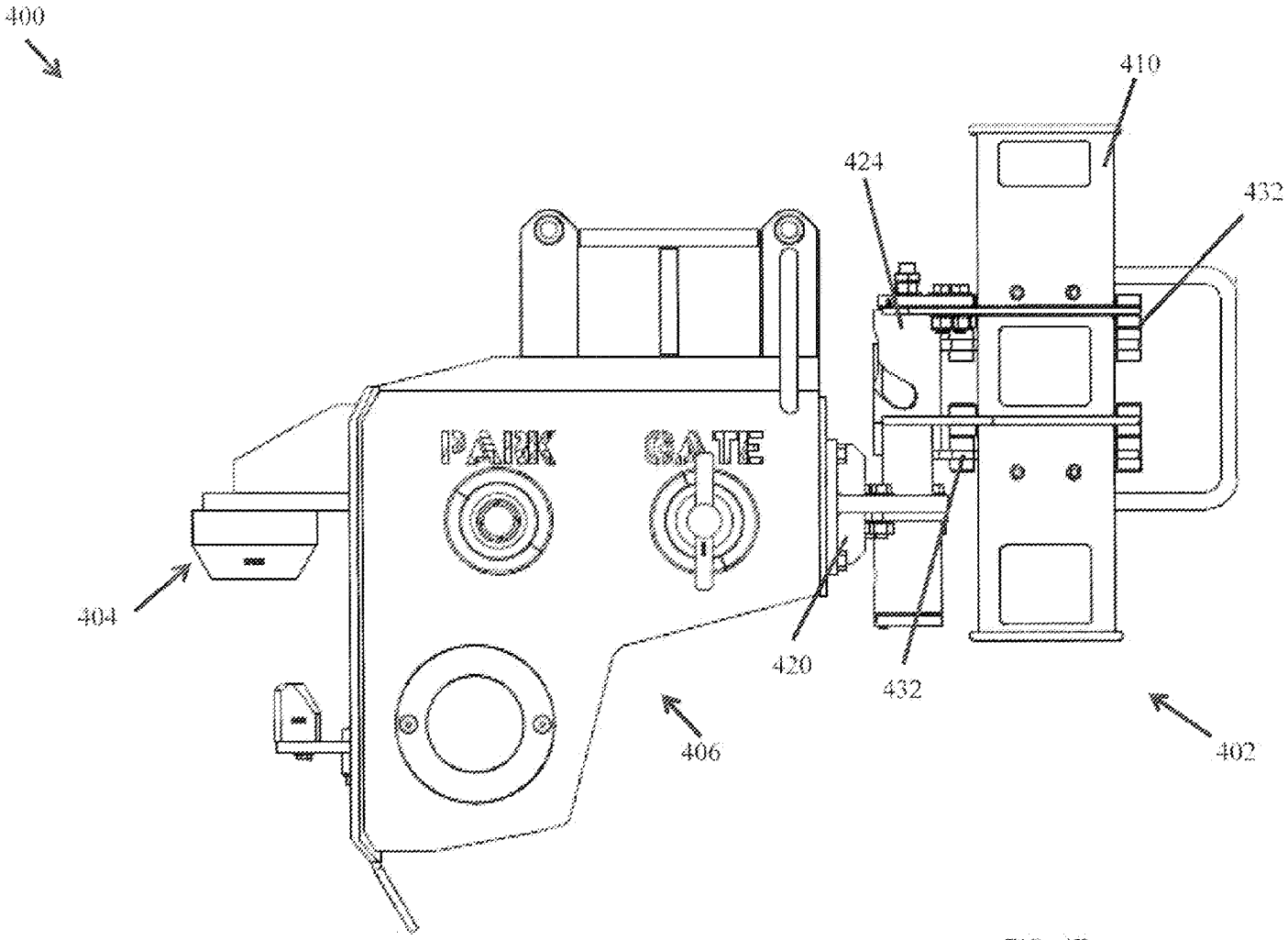
FIG. 4E is a left-side view of the guide of FIG. 4A, according to an exemplary embodiment.

FIG. 3 is a perspective view of the guide basket 300, according to an exemplary embodiment. The guide basket 300 includes a rectangular mud mat 302 having multiple openings 304 spaced apart therein. The openings 304 allow the guide basket 300 to sit on the seafloor which may consist of unconsolidated marine sediments. The holed structure of the mud mat 302 is preferred to a single large flat surface, as the openings 304 reduce drag compared to a flat surface during deployment and retrieval when pulling through the water column. In certain embodiments, the guide basket 300 includes a bumper rail 306 extending orthogonal to and around the perimeter of the mud mat 302. The bumper rail 306 reduces damage in the event of clashing with the moon pool walls or drilling riser 110 during deployment and/or retrieval. Two side columns 310 extend from opposing sides of the bumper rail 306 in a direction generally orthogonal to the mud mat 302. Two rectangular lower receptacle plates 314 are secured between lower portions 310*a* of the side columns 310. Two rectangular upper receptacle plates 316 are secured between upper portions 310*b* of the side columns 310. Each of the receptacle plates 314, 316 include multiple openings 320 sized to receive a portion of the guides 126 therein. In certain embodiments, each of the receptacle plates 314, 316 include six openings. In certain embodiments, the lower receptacle plates 314 have a width larger than the upper receptacle plates 316. The upper portions 310*b* of the side columns 310 also include grab handles 322. In certain embodiments, an upper cross plate 324 extends between upper ends 310*c* of the side columns 310. The cross plate 324 includes a lifting eye 326.

Referring to FIGS. 4A-4E, an exemplary embodiment of a guide 400 to be used in conjunction with system 100 is shown. The guide 400 includes an umbilical interface assembly 402 configured to interface with the umbilical 102, a riser interface assembly 404 configured to interface with the drilling riser 110, and a frame assembly 406 that extends between the umbilical interface assembly 402 and the riser interface assembly 404. It should be appreciated that many other alternative embodiments of the present disclosure exist, such as those described in U.S. patent application Ser. No. 13/217,440.

Generally, the umbilical interface assembly 402 includes a clam shell portion 410 and an umbilical interface actuation assembly 412. The clam shell portion 410 is configured to be driven to an opened orientation (not shown) by the umbilical interface actuation assembly 412, wherein it is arranged to receive a segment of the umbilical 102, and configured to be driven to a closed orientation by the umbilical interface actuation assembly 412, wherein it retains the segment of the umbilical 102 therein. The clam shell portion 410 is configured to limit the movement of the umbilical 102 in the horizontal plane (x-y plane) while allowing the umbilical 102 to move freely in a vertical direction (z-direction). In certain embodiments, the interior of the clam shell portion 410 includes a polished stainless steel surface so as to prevent damage to the umbilical 102 therein. In certain embodiments, the clam shell portion 410 includes a generally cylindrical body 414 having a first portion 416 that pivots relative to a second portion 418. In certain exemplary embodiments, the first portion 416 moves about an axis extending along the length of the cylindrical body 414, while the second portion 418 is stationary when the umbilical interface actuation assembly 412 is actuated. In certain exemplary embodiments, the first portion 416 pivots through at least 60 degrees (e.g., 90, degrees, 110 degrees) such that the first portion 416 is moved sufficiently out of the way so that the umbilical 102 can be easily directed into the target area, which is adjacent the inner surface of the second portion 418.

The umbilical interface actuation assembly 412 includes a frame mount 420 that supports a normally locked pivot connection 422 between the frame mount 420 and the second portion 418 of the clam shell portion 410, and a driven pivot connection 424 between the frame mount 420 and the first portion 416. The driven pivot connection 424 includes a hydraulic actuated device 430 that rotates the first portion 416 of the clam shell portion 410 relative to the second portion 418 of the clam shell portion 410. When the driven pivot connection 424 is rotated, it engages locking pins 432 that retain the first portion 416 to the second portion 418 so that continuous hydraulic pressure is not needed to keep the clam shell portion 410 closed. The normally locked pivot connection 422 is configured to normally be locked to prevent movement of the second portion 418, and configured to be mechanically unlocked to allow for movement of the second portion 418. Direct manual movement of the second portion 418 may be desirable in the event of a malfunction of the driven pivot connection 424 or actuation assembly 412.

In certain embodiments, the umbilical interface actuation assembly 412 is driven by hydraulic fluid. A hydraulic connection 434 is provided on a side surface of the frame assembly 406. The hydraulic connection 434 is configured such that ROV 130 can remove a plug from the hydraulic connection 434 and temporarily store (park) the plug on a holding structure 436 on the frame assembly 406. Once the plug is removed, a hydraulic line can be provided by the ROV 130 and can be directly connected to the hydraulic connection 434 and thereafter used to hydraulically actuate the umbilical interface actuation assembly 412.

Figure 5:
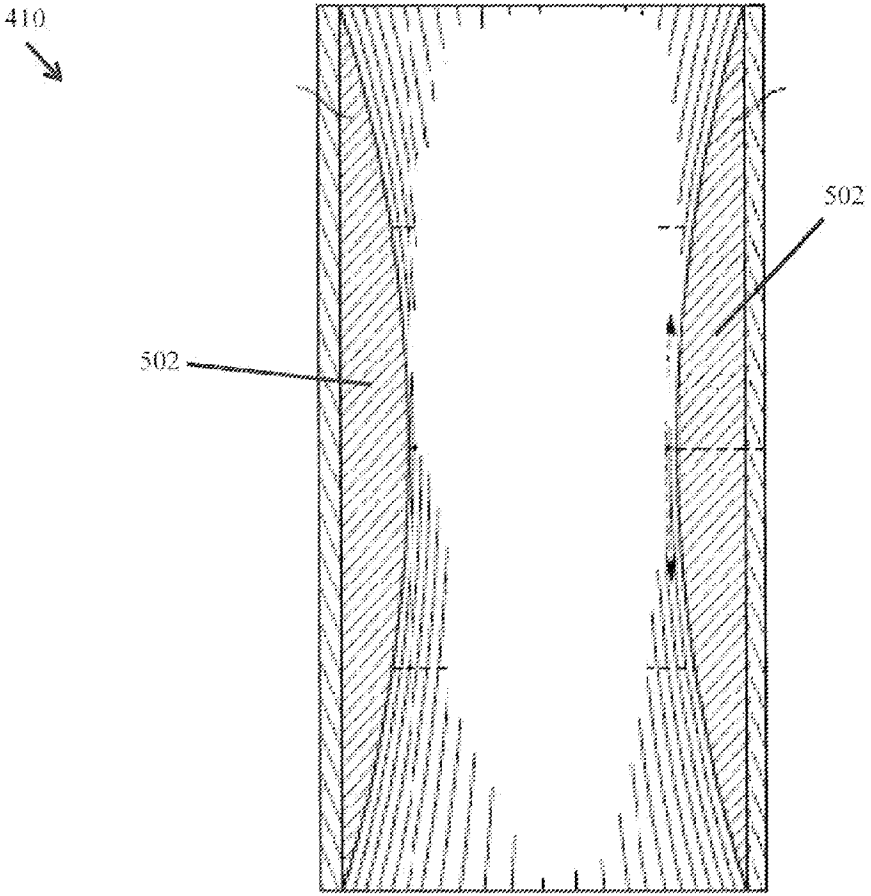
FIG. 5 is a side cross-sectional view of a clam shell portion of the guide of FIG. 4A, according to an exemplary embodiment.

Referring now to FIG. 5, a side cross-sectional view of the clam shell portion 410 is shown. The geometry of the clam shell portion 410 is configured to prevent damage to the umbilical 102 due to bending, compression, or excessive wear. In certain embodiments, the inner surface forms a sleeve having a generally cylindrical outer shape and a pair of tapered wear inserts 502 that define its inner shape. The wear inserts 502 can be tapered from both ends towards a central region. The cross-sectional profile of the wear inserts 502 define a smooth curve wherein at least a portion of the curve has a radius of curvature that is greater than or equal to the minimum recommended radius of curvature for the umbilical, thus preventing contact between the guide 400 and the umbilical 102 so that the umbilical 102 does not bend beyond its minimum recommended radius of curvature. In certain exemplary embodiments, the entire cross-sectional profile includes a constant radius of curvature. In alternative embodiments, the cross-sectional profile may be defined by multiple curves. It should be appreciated that many other alternative configurations for the umbilical interface exists.

The present invention is directed to a system, method, and apparatus useful for independent IWOCS deployment in which the IWOCS umbilical, terminated to the UTA, may be run in a detached manner from critical path operations. The invention may be characterized by several features and advantages in different configuration, which includes time savings during drilling riser running compared to a conventional method of clamping IWOCS umbilical to the riser. For instance, conventional methods of clamping the IWOCS umbilical to the drilling riser require approximately ten minutes per riser joint to install clamps, which represents a delay to the critical path operation. In the present invention, in 7,000 feet water depth, approximately 16 hours of rig time can be saved per riser trip by avoiding the need for installing clamps on critical path. Other features and advantages include, but are not limited to independent retrievability of IWOCS/UTA in the event of failure, IWOCS deployment taken off of critical path drill floor operations, and reduction of wear and tear on equipment, as in the instance wherein the umbilical is retrieved from drilling riser when not in use.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. While numerous changes may be made by those skilled in the art, such changes are encompassed within the spirit of this invention as defined by the appended claims. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. The terms in the claims have their plain, ordinary meaning unless otherwise explicitly and clearly defined by the patentee.

What is claimed is:

1. An installation and workover control system comprising:

a drilling riser extending between a deepwater drilling unit and a subsea controls package;

an umbilical extending between the deepwater drilling unit and the subsea controls package;

one or more guide assemblies for securing the umbilical to the drilling riser, wherein the one or more guide assemblies are fixedly coupled to the drilling riser, wherein the umbilical is movable within the one or more guide assemblies in a vertical direction, wherein the umbilical is restrained laterally with the one or more guide assemblies, and wherein the one or more guide assemblies allow deployment and retrieval of the umbilical independently from the deployment of the drilling riser;

an umbilical interface assembly, the umbilical interface assembly being configured for releasably retaining the umbilical with respect to the drilling riser;

a frame assembly connected to the umbilical interface assembly; and a riser interface assembly connected to the frame assembly, the riser interface assembly being adapted for releasable connection of the guide assembly to the drilling riser.

2. The system of claim 1, further comprising a remotely operated vehicle for installing or retrieving the riser interface assembly from the drilling riser.

3. The system of claim 1, wherein one or more guide assemblies comprises an umbilical interface assembly having a clam shell portion for receiving and retaining at least a portion of the umbilical therein.

4. The system of claim 3, wherein opening and closing of the clam shell portion the umbilical interface assembly can be actuated by a remotely operated vehicle.

5. The system of claim 1, further comprising at least one load member coupled to the umbilical.

6. The system of claim 1, wherein the guide assemblies are positioned unevenly along a length of the drilling riser.

7. The system of claim 1, wherein the umbilical comprises an aramid fiber strength member.

8. A method of installing a workover controls system for deployment of an umbilical from a deepwater drilling vessel, the method comprising the steps of:

(a) deploying a drilling riser from the deepwater drilling vessel into a body of fluid;

(b) deploying the umbilical from the deepwater drilling vessel into the body of fluid, wherein the umbilical is deployed independently from the drilling riser;

(c) securing the umbilical to the drilling riser with one or more guide structures, wherein the one or more guide structures are fixedly coupled to the drilling riser, wherein the umbilical is movable within the one or more guide structures in a vertical direction, wherein the umbilical is restrained laterally with the one or more guide structures;

(d) an umbilical interface assembly, the umbilical interface assembly being configured for releasably retaining the umbilical with respect to the drilling riser, the umbilical interface assembly being configured to facilitate deployment and retrieval of the umbilical independently from the deployment of the drilling riser;

(e) a frame assembly connected to the umbilical interface assembly, and (f) a riser interface assembly connected to the frame assembly, the riser interface assembly being adapted for releasable connection of the guide assembly to the drilling riser.

9. The method of claim 8, wherein a remotely operated vehicle couples the guide structures to the drilling riser.

10. The method of claim 8, wherein a remotely operated vehicle couples the guide structures to the umbilical.

11. The method of claim 8, wherein the guide structures are coupled to the drilling riser before the umbilical is secured to the guide structures.

12. The method of claim 8, wherein an axial tension is applied on the umbilical.

13. A method of deploying or retrieving an umbilical, the method comprising the steps of:

(a) providing one or more guide assemblies for securing the umbilical to a drilling riser;

(b) providing a riser interface assembly, the riser interface assembly being adapted for releasable connection of the guide assemblies to the drilling riser;

(c) conveying an umbilical from a deepwater drilling unit to or from a position below a surface of a body of fluid, the umbilical being conveyed independently and laterally offset from a drilling riser, wherein the drilling riser is associated with the deepwater drilling unit, wherein the drilling riser extends into the body of fluid;

(d) providing respective umbilical interface assemblies connected to the respective guide assemblies, the umbilical interface assemblies being configured for releasably retaining the umbilical with respect to the drilling riser, the umbilical interface assemblies being configured to facilitate deployment and retrieval of the umbilical independently from the deployment of the drilling riser, at least one umbilical interface assembly having a clam shell portion capable of opening and closing, the clam shell portion being configured for opening to receive and then closing to retain at least a portion of the umbilical;

(e) restraining the umbilical laterally with riser mounted guide structures, wherein the riser mounted guide structures are fixedly coupled to the drilling riser, and wherein the umbilical is movable within the riser mounted guide structures in a vertical direction.

14. The method of claim 13, wherein the monitoring step further comprises monitoring the umbilical during umbilical deployment and after connection of the umbilical to a lower marine riser package.

15. The method of claim 13, wherein the umbilical is coupled to an umbilical termination assembly, and wherein the conveying step comprises employing a remotely operated vehicle to guide the umbilical termination assembly through a portion of the body of fluid adjacent to the drilling riser.

16. The method of claim 13, further comprising the step of connecting load members to the umbilical, wherein the load members regulate loads applied to the umbilical during deployment.

17. The method of claim 13, further comprising the step of deploying a remotely operated vehicle to interface with the guide structures.

* * * * *